US006511005B2

(12) United States Patent
Bouchillon et al.

(10) Patent No.: US 6,511,005 B2
(45) Date of Patent: Jan. 28, 2003

(54) BOWL CENTRIFUGE NOZZLE

(75) Inventors: Charles W. Bouchillon, Starkville, MS (US); Kim E. Greenwell, Springfield, OH (US)

(73) Assignee: Fluid-Quip, Inc., Springfield, OH (US)

( * ) Notice: Subject to any disclaimer, the term of this patent is extended or adjusted under 35 U.S.C. 154(b) by 5 days.

(21) Appl. No.: 09/822,594

(22) Filed: Mar. 30, 2001

(65) Prior Publication Data

US 2002/0153437 A1 Oct. 24, 2002

(51) Int. Cl.[7] ..... A62C 31/02; B05B 1/00; B05B 1/04; B05B 3/10

(52) U.S. Cl. ..... 239/589; 239/591; 239/595; 239/223

(58) Field of Search ..... 239/589, 223, 239/224, 591, 595, 598, 599, 601, 538, 380, 240

(56) References Cited

U.S. PATENT DOCUMENTS

| | | | |
|---|---|---|---|
| 668,484 | A | 2/1901 | Bök |
| 1,557,994 | A | 10/1925 | Dyson et al. |
| 2,060,239 | A | 11/1936 | Peltzer |
| 2,410,313 | A | 10/1946 | Strezynski |
| 2,695,748 | A | 11/1954 | Millard |
| 2,719,003 | A | 9/1955 | Strezynski |
| 2,855,182 | A | 10/1958 | Payne |
| 3,300,142 | A | 1/1967 | Brown |
| 4,005,817 | A | 2/1977 | Charlton et al. |
| 4,059,223 | A | 11/1977 | Lewis |
| 4,121,770 | A | 10/1978 | Straarup et al. |
| 4,311,270 | A | 1/1982 | Hovstadius |
| RE30,963 | E | 6/1982 | Moller et al. |
| 4,430,071 | A | 2/1984 | Willus et al. |
| 4,505,697 | A | 3/1985 | Lee et al. |
| 4,643,709 | A | 2/1987 | Lee et al. |
| 4,646,695 | A | 3/1987 | Blackburn |
| 4,718,886 | A | 1/1988 | Mackel |
| 4,898,331 | A | 2/1990 | Hansen et al. |
| 5,033,680 | A | 7/1991 | Schultz |
| 5,300,014 | A | 4/1994 | Chin et al. |
| 5,683,342 | A | 11/1997 | McNair |
| 5,894,964 | A | 4/1999 | Barnes et al. |
| 5,947,076 | A | 9/1999 | Srinivasan et al. |
| 6,216,959 | B1 * | 4/2001 | Garrison et al. ..... 239/1 |

* cited by examiner

*Primary Examiner*—Michael Mar
*Assistant Examiner*—Davis Hwu
(74) *Attorney, Agent, or Firm*—Wood, Herron & Evans, L.L.P.

(57) ABSTRACT

An outlet nozzle for use within a centrifuge rotor. The outlet nozzle includes an axial inlet channel and an outlet channel disposed angularly with respect to the inlet channel. An insert is received within the holder and includes an orifice portion and a directing portion. The directing portion shields at least a portion of the outlet channel for preventing impact therewith and for diverting fluid flow from the inlet channel of the holder and into the orifice portion of the insert. The insert further includes an inlet edge at a proximal end which is defined by the intersection of the outlet channel and the inlet channel.

10 Claims, 5 Drawing Sheets

BOWL CENTRIFUGE NOZZLE

BACKGROUND OF THE INVENTION

1. Field of the Invention

The present invention relates to an outlet nozzle for use within bowl centrifuges and, more particularly, to an outlet nozzle including an improved insert for facilitating streamlined fluid flow therethrough.

2. Description of the Related Art

Bowl centrifuges of a nozzle type typically include a rotor defining a separating chamber containing separating discs for effecting a two-fraction separation of feed slurry. The feed slurry is separated into a heavy discharge slurry, or underflow fraction, which is delivered outside the rotor by a plurality of nozzles supported within the outer wall of the rotor. A light fraction or separated liquid is removed from the rotor by overflow from the top end of the machine.

To effect proper separation of the feed slurry, it is necessary to rotate the rotor within a conventional bowl centrifuge at a high rotational speed. The high rotational speed of the rotor creates sufficient centrifugal force to separate the heavy discharge slurry outwardly to the nozzles supported within the outer wall of the rotor.

One arrangement illustrating centrifuge nozzles secured within a rotor wall is disclosed in U.S. Pat. No. 2,695,748 to Millard, the disclosure of which is incorporated herein by reference. A plurality of nozzles are mounted at regularly spaced intervals about the periphery of the rotor wall. More particularly, the rotor wall is provided with a plurality of cylindrical bores for receiving the nozzles wherein the axis of each bore is radially disposed with respect to the axis of the rotor. A lug is formed integral with the body of the nozzle for detachably securing each nozzle within the rotor wall.

The fluid pressure entering the nozzle is often in the order of one thousand pounds per square inch (psi). Consequently, this results in very high velocities in the discharge orifice of the nozzle. Such high velocities result in the requirement of a high wear resistant material for the nozzle.

Conventional nozzles comprise a holder including an axial inlet channel and an outlet channel angularly disposed relative to the inlet channel. An insert of material harder than that of the nozzle holder is typically secured within the outlet channel wherein the flow of fluid is diverted from the inlet channel to the outlet channel and out through the orifice defined by the insert. The inserts of prior art nozzles have been designed to insure that the inner surface facing the inlet channel forces the fluid flowing through the inlet channel to change direction before it can arrive at the orifice. Damage, particularly due to cavitation and erosion from impact by the fluid against the inner surfaces of the channels, frequently occurs to the nozzle holder. Traditionally, such damage may lead not only to rapid failure of the nozzle, but also to damage of the centrifuge rotor itself.

In order to reduce the wear rate of the holder, U.S. Pat. No. 5,033,680 proposes providing an outlet nozzle including a nozzle holder and means forming an orifice comprising an entry cone with a semi-circular recess on the same axis of symmetry of an intake channel, having the same radius as the intake channel, and immediately adjacent thereto.

While the outlet nozzle disclosed in U.S. Pat. No. 5,033,680 significantly reduces wear on the nozzle holder, it does not provide for an efficient flow of fluid from the intake channel to the orifice. As such, there is a need for a centrifuge nozzle having an improved insert for reducing wear to the nozzle holder and for providing a streamlined fluid flow condition from the inlet channel to the insert orifice.

SUMMARY OF THE INVENTION

The present invention provides an outlet nozzle for use within a centrifuge rotor, the outlet nozzle comprising a holder including an axial inlet channel having an inner surface and defining an inlet axis, and an outlet channel having an inner surface, defining an outlet axis, and in fluid communication with the inlet channel along an intersection. The outlet axis is disposed angularly in a non-parallel relation to the inlet axis.

An insert including a proximal end and an opposing distal end is supported by a holder. The insert is composed of a first material and the holder is composed of the second material, wherein the first material is harder than the second material. The distal end is received within the outlet channel and the proximal end extends within the inlet channel. The insert further includes an inner surface and an orifice at the distal end. The inner surface includes an orifice portion adjacent the distal end and a directing portion adjacent the proximal end. The directing portion shields at least a portion of the inner surface of the outlet channel for preventing impact therewith and for diverting fluid flow from the inlet channel of the holder and into the orifice portion of the insert.

The insert further includes an inlet edge at the proximal end which is defined by the intersection of the outlet channel and the inlet channel. More particularly, the intersection is defined as the geometric location where fluid is redirected from the inlet channel to the outlet channel. The outlet axis crosses the inlet axis at an intersection point, wherein the inlet edge intersects a directing line extending through the intersection point perpendicular to both the outlet axis and the inlet axis. The inner surface of the inlet channel includes opposing front and rear portions, wherein the inlet edge includes a first portion extending from the front portion of the inner surface to the directing line and a second portion extending from the rear portion of the inner surface to the directing line.

Objects and advantages of the invention will be apparent from the following description, the accompanying drawings and the appended claims.

DETAILED DESCRIPTION OF THE PREFERRED EMBODIMENT

Figure 1:
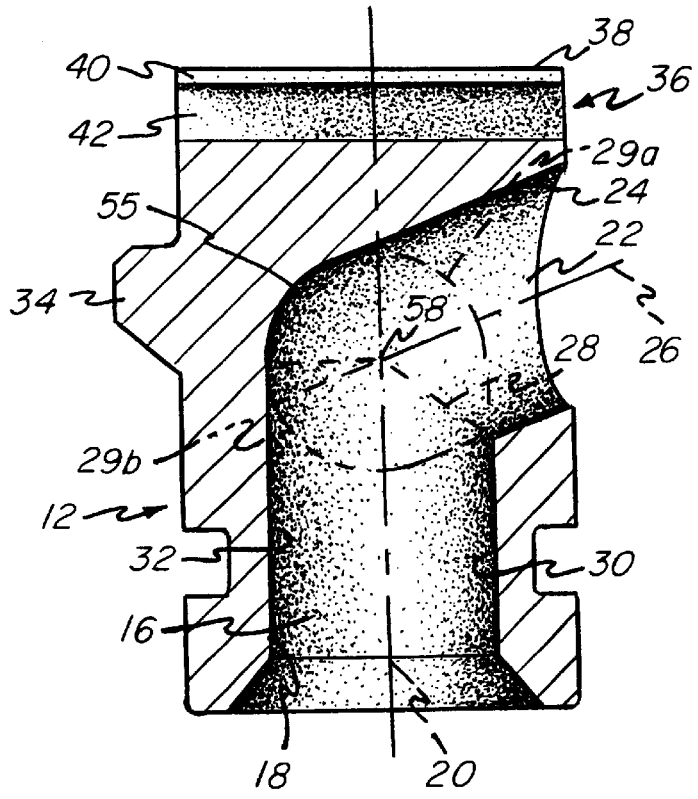
FIG. 1 is a cross-sectional view of the holder of the present invention.
Figure 2:
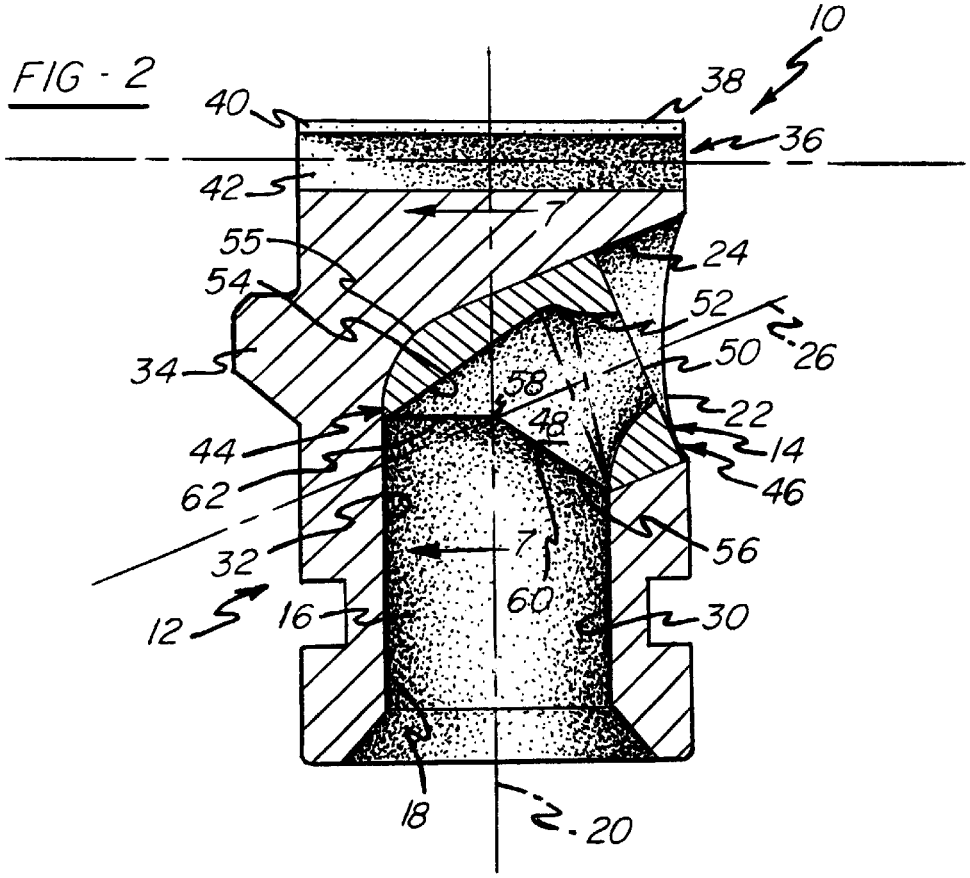
FIG. 2 is a cross-sectional view of the outlet nozzle of the present invention taken along line 2—2 of FIG. 3 illustrating the insert received within the holder.
Figure 3:
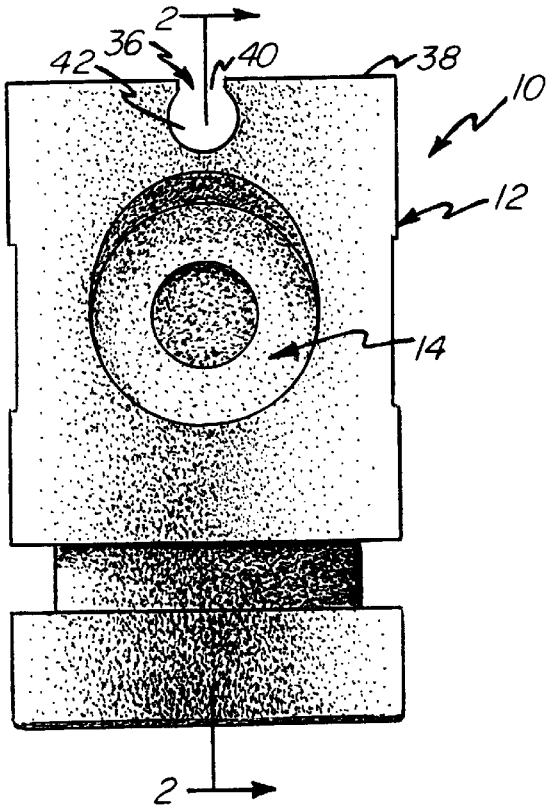
FIG. 3 is a front elevational view of the outlet nozzle of FIG. 2.
Figure 4:
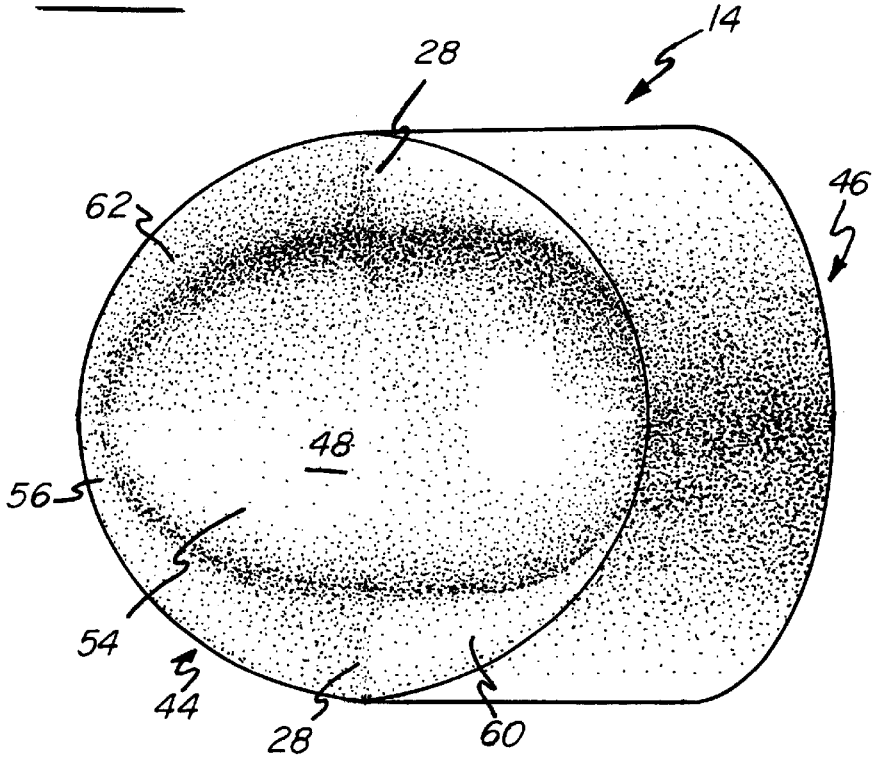
FIG. 4 is a perspective view of the insert of FIG. 2.
Figure 5:
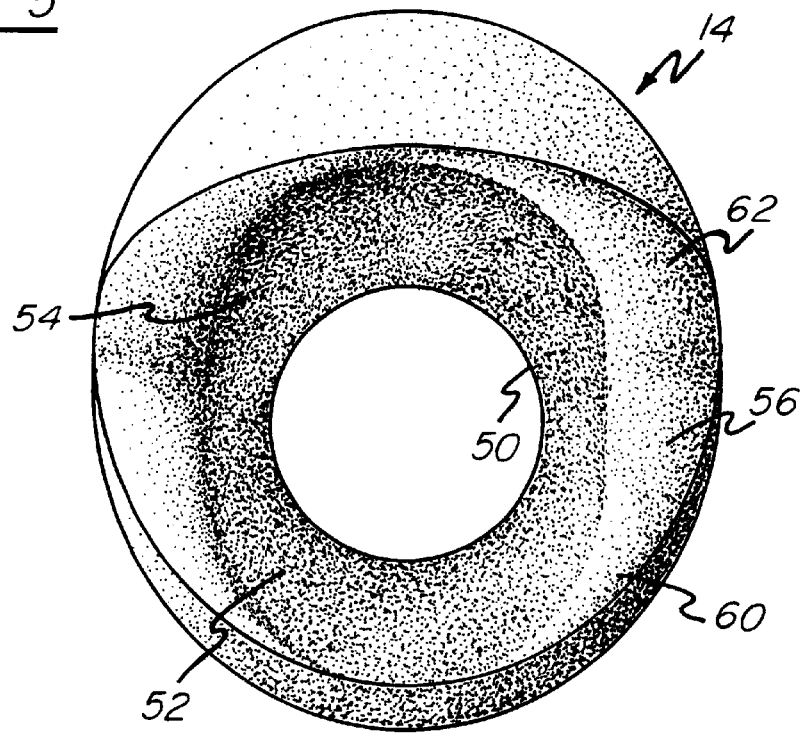
FIG. 5 is a proximal end view of the insert of FIG. 2.
Figure 6:
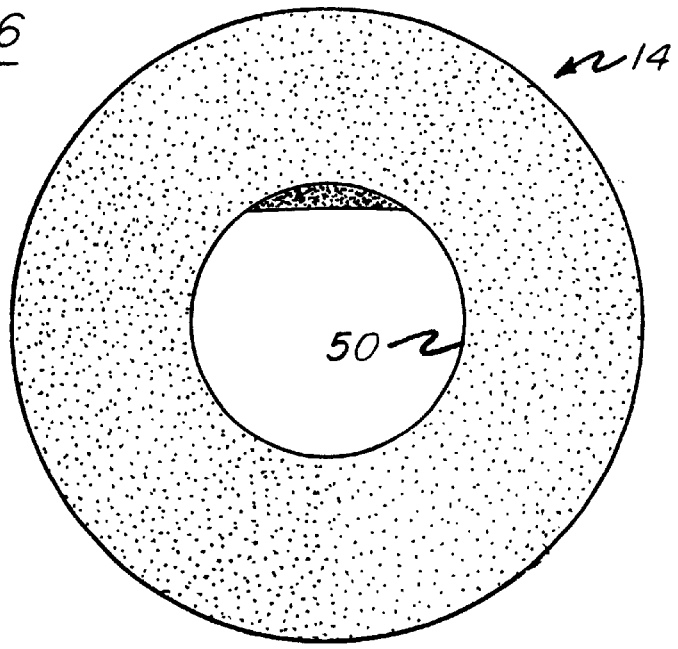
FIG. 6 is a distal end view of the insert of FIG. 2.

Referring initially to FIGS. 1–3, the nozzle 10 of the present invention is the type adapted for use within a conventional bowl centrifuge (not shown). The nozzle 10 includes a nozzle holder 12 for receiving an insert 14. The holder 12 includes an axial inlet channel 16 having an inner surface 18 and defining an inlet axis 20. The holder 12 further includes an outlet channel 22 having an inner surface 24 and defining an outlet axis 26. The inlet channel 16 is in fluid communication with the outlet 22 along an intersection 28. The intersection 28 is geometrically defined as the location where fluid flow is redirected from the inlet channel 16 to the outlet channel 22. More particularly, the outlet axis 26 is disposed at an angle to the inlet axis 20 such that fluid flow passing through the inlet channel 16 in a direction substantially parallel to the inlet axis 20 is redirected angularly in a direction substantially parallel to the outlet axis 26.

The inlet channel 16 is preferably formed by machining into the holder 12 with a spherically ended drill bit, illustrated in phantom in FIG. 1 as reference numeral 29*a*. The outlet channel 22 is then similarly machined into the holder 12 through the use of a spherically ended drill bit, illustrated in phantom in FIG. 1 as reference numeral 29*b*, passing at an angle to the inlet channel 16 and intercepting the bottom of the previously drilled inlet channel 16 at reference numeral 29*a*.

The inner surface 18 of the inlet channel 16 includes opposing front and rear portions 30 and 32. A locking mechanism, preferably a lug 34, extends radially outwardly from the holder 12 and is preferably diametrically opposed to the outlet channel 22. As is known in the art, the lug 34 is positioned within a locking groove of a rotor wall (not shown) thereby preventing movement of the holder 12 in a direction parallel to the inlet axis 20. A diametrically disposed placement channel 36 is provided within an end face 38 of the holder 12. The placement channel 36 defines a slot 40 and a bore 42 positioned inwardly along the inlet axis 20 relative to the slot 40. Additional details regarding the placement channel 36 are provided in co-pending U.S. patent application Ser. No. 09/529,092 which is assigned to the Assignee of the present invention and is incorporated herein by reference.

The insert 14 is formed of a first material while the holder 12 is formed of a second material, wherein the first material is harder than the second material. More particularly, the first material of the insert 14 may comprise a metal or other erosion and corrosion resistant material, such as a hardened metal, a metal alloy such as tungstin carbide, or a ceramic material. The insert 14 includes opposing proximal and distal ends 44 and 46. The distal end 46 is received within the outlet channel 22 and the proximal end 44 extends within the inlet channel 16. The insert 14 further includes an inner surface 48 and an orifice 50 at the distal end 46.

The inner surface 48 of the insert 14 includes an orifice portion 52 adjacent the distal end 46. The orifice portion 52 is preferably substantially bell-shaped in order to provide a smooth or streamlined transition from a large diameter channel to a relatively small diameter orifice 50. While the orifice portion 52 is preferably bell-shaped, it maybe appreciated that a conical transition, while not as efficient as the bell-mouth transition, may be utilized. The preferred configuration of the insert 14 utilizes a substantially continuous change in direction as provided by a smooth curved surface.

The insert 14 also includes a directing portion 54 which shields at least a portion of the inner surface 24 of the outlet channel 22 for preventing fluid impact therewith. Moreover, the inner surface 48 of the directing portion 54 limits the erosion or wear in the high velocity areas of the flow where the flow is redirected from the inlet channel 16 to the orifice 50. This condition generally occurs at the end wall 55 which is common to both the inlet channel 16 and the outlet channel 22.

The insert 14 further includes an inlet edge 56 at the proximal end 44 and defined by the geometric intersection of the outlet channel 22 and the inlet channel 16. More particularly, the inlet edge 56 is geometrically defined to approximate the location where fluid flow is redirected from the inlet channel 16 and into the outlet channel 22 for passage through the insert 14, and more particularly, through the orifice 50. The inlet edge 56 passes along the intersection 28 and through a directing line 58 extending through an intersection point between the outlet axis 26 and the inlet axis 20. The directing line 58 is disposed perpendicularly to both the outlet axis 26 and the inlet axis 20. The inlet edge 56 includes a first portion 60 extending from the front portion 30 of the inner surface 18 to the directing line 58, and a second portion 62 extending from the rear portion 32 of the inner surface 18 to the directing line 58.

Figure 7:
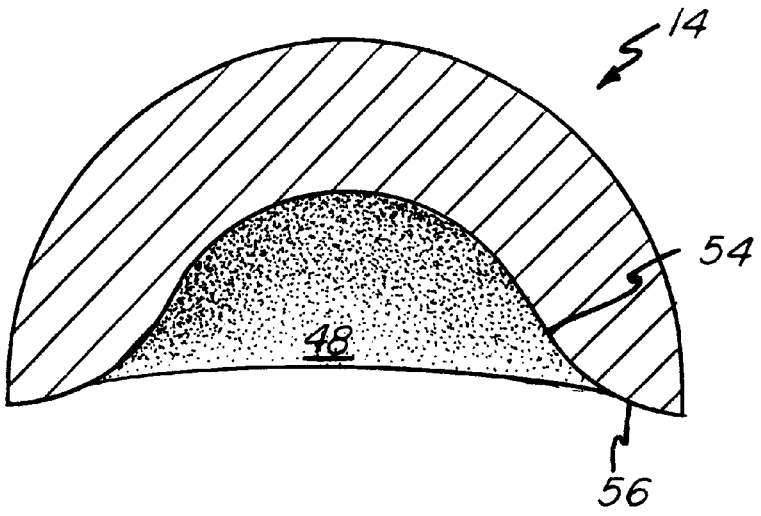
FIG. 7 is a cross-sectional view of the insert of the present invention taken along line 7—7 of FIG. 2.

Furthermore, as illustrated in FIGS. 2 and 7, the inlet edge 56 is curved from the inner surface 18 of the inlet channel 16 in a direction inwardly toward the inner surface 48 of the insert 14. Such an arcuate surface of the inlet edge 56 facilitates a streamlined flow.

Figure 8:
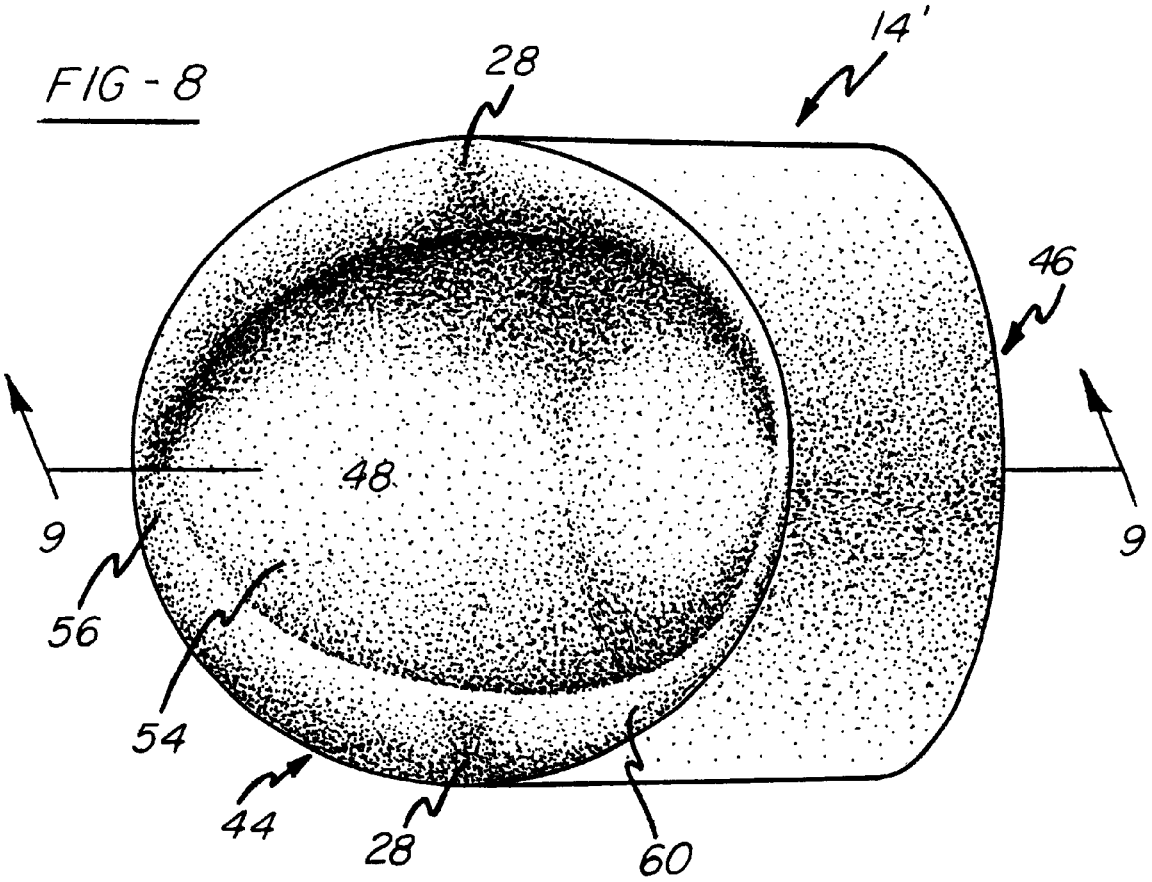
FIG. 8 is a perspective view of an alternative embodiment of the insert of the present invention.
Figure 9:
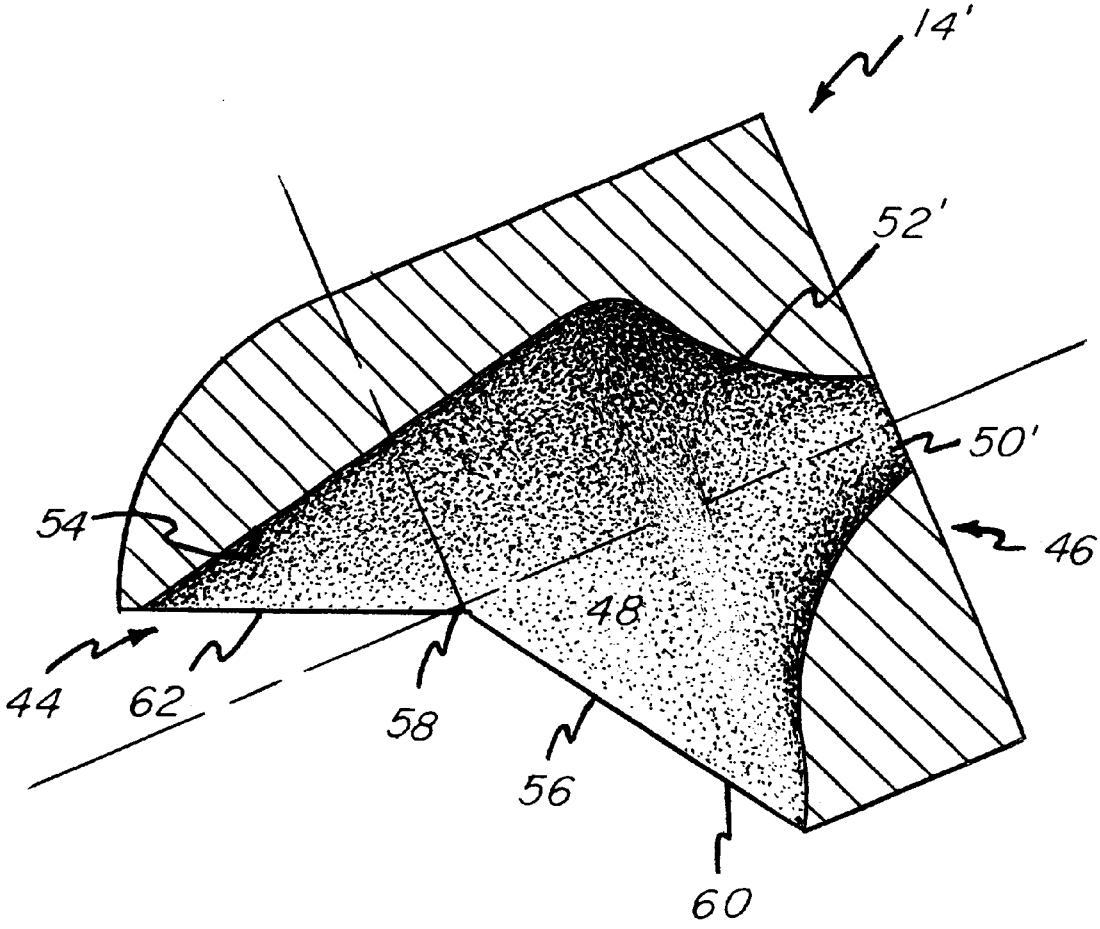
FIG. 9 is a cross-sectional view taken along line 9—9 of FIG. 8.

Referring now to FIGS. 8 and 9, an alternative embodiment of the insert 14' is illustrated as including an orifice 50' of a diameter less than the orifice 50 of the insert 14. As such, the bell-shaped transition curve within the orifice portion 52' is of a different shape than the bell-shaped transition curve within the orifice portion 52. The remaining elements of the insert 14' are identical to those elements as described above with respect to the condition adjacent the inner surface 16 insert 14.

In operation, fluid is centrifugally forced by rotation of the centrifuge rotor into the holder 12 in a direction substantially parallel to the inlet axis 20. Upon reaching an end of the inlet channel 16, the fluid impacts the inner surface 48 of the insert 14 positioned within the outlet channel 22. The inner surface 48 in the directing portion 54 of the insert 14 causes the fluid flow to alter its course in a direction substantially parallel to the outlet axis 26. The fluid then passes through the orifice 50 and exits the outlet nozzle 10. The redirecting portion 54 shields the inner surface of the end wall 55 from direct impact by the high velocity fluid, thereby preventing erosion thereto. Furthermore, the inlet edge 56 provides for a smooth fluid flow transition from the inlet channel 16 into the insert 14. Finally, the bell-shaped inner surface 48 of the orifice portion 52 and provides for a smooth streamlined fluid flow out through the orifice 50.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An outlet nozzle for use within a centrifuge rotor, said outlet nozzle comprising:

a holder including an axial inlet channel having an inner surface and defining an inlet axis, and an outlet channel having an inner surface, defining an outlet axis and in fluid communication with said inlet channel along an intersection, said outlet axis disposed in nonparallel relation to said inlet axis;

an insert including a proximal end and an opposing distal end, said distal end received within said outlet channel and said proximal end extending within said inlet channel, said insert further including an inner surface and an orifice at said distal end, said inner surface having an orifice portion adjacent said distal end and arcuately converging toward said outlet axis, and a directing portion adjacent said proximal end, said directing portion shielding at least a portion of said inner surface of said outlet channel for preventing fluid impact therewith and for diverting fluid flow from said inlet channel of said holder and into said orifice portion of said insert; and wherein said insert further includes an inlet edge at said proximal end, said inlet edge defined by said intersection of said outlet channel and said inlet channel.

2. The outlet nozzle of claim 1 wherein said outlet axis crosses said inlet axis at an intersection point, a directing line extends through said intersection point perpendicular to said outlet axis and said inlet axis, and said inlet edge extends through said directing line.

3. The outlet nozzle of claim 2 wherein said inner surface of said inlet channel includes opposing front and rear portions, said inlet edge including a first portion extending from said front portion of said inner surface to said directing line and a second portion extending from said rear portion of said inner surface to said directing line.

4. The outlet nozzle of claim 1 wherein said inlet edge is curved from said inner surface of said inlet channel inwardly toward said inner surface of said insert.

5. The outlet nozzle of claim 1 wherein said insert is composed of a first material and said holder is composed of a second material, said first material harder than said second material.

6. An outlet nozzle for use within a centrifuge rotor, said outlet nozzle comprising:

a holder including an axial inlet channel having an inner surface and defining an inlet axis, and an outlet channel having an inner surface, defining an outlet axis and in fluid communication with said inlet channel, said outlet axis disposed in nonparallel relation to said inlet axis;

an insert including a proximal end and an opposing distal end, said distal end received within said outlet channel and said proximal end extending within said inlet channel, said insert further including an inner surface and an orifice at said distal end, said inner surface having an orifice portion adjacent said distal end and a directing portion adjacent said proximal end, said directing portion shielding at least a portion of said inner surface of said outlet channel for preventing fluid impact therewith and for diverting fluid flow from said inlet channel of said holder and into said orifice portion of said insert; and wherein said insert further includes an inlet edge at said proximal end, said inlet edge curved from said inner surface of said inlet channel inwardly toward said inner surface of said insert.

7. The outlet nozzle of claim 6 wherein said outlet axis crosses said inlet axis at an intersection point, a directing line extends through said intersection point perpendicular to said outlet axis and said inlet axis, and said inlet edge extends through said directing line.

8. The outlet nozzle of claim 7 wherein said inner surface of said inlet channel includes opposing front and rear portions, said inlet edge including a first portion extending from said front portion of said inner surface to said directing line and a second portion extending from said rear portion of said inner surface to said directing line.

9. The outlet nozzle of claim 6, wherein said inner surface of said orifice portion of said insert arcuately converges toward said outlet axis.

10. The outlet nozzle of claim 6 wherein said insert is composed of a first material and said holder is composed of a second material, said first material harder than said second material.

* * * * *